US005745941A

United States Patent [19]

Miller, Sr.

[11] Patent Number: 5,745,941

[45] Date of Patent: May 5, 1998

[54] AIR SUPPORT MATTRESS OVERLAY WITH FITTED SHEET MOUNTING

[75] Inventor: Craig S. Miller, Sr., Yorba Linda, Calif.

[73] Assignee: Foamex L.P., Linwood, Pa.

[21] Appl. No.: 799,205

[22] Filed: Feb. 13, 1997

[51] Int. Cl.[6] ..... A47C 27/10

[52] U.S. Cl. ..... 5/710; 5/691; 5/713

[58] Field of Search ..... 5/710, 713, 714, 5/706, 691, 903

[56] References Cited

U.S. PATENT DOCUMENTS

| | | | |
|---|---|---|---|
| 3,958,286 | 5/1976 | Rodinsky | 5/691 |
| 4,267,611 | 5/1981 | Agulnick | 5/691 |
| 4,517,693 | 5/1985 | Viesturs | 5/691 |
| 4,924,541 | 5/1990 | Inagaki | 5/691 |
| 5,090,077 | 2/1992 | Caden et al. | 5/713 |
| 5,267,364 | 12/1993 | Volk | 5/713 |
| 5,634,225 | 6/1997 | Miller, Sr. et al. | 5/710 |

*Primary Examiner*—Alexander Grosz
*Attorney, Agent, or Firm*—Natan Epstein

[57] ABSTRACT

An inflatable overlay for a bed mattress has a base sheet with a top and sides sized to retentively fit over the mattress, and inflatable elements secured to the sheet defining a body support surface. Impermeable sheet material is layered on the base sheet to form air conduits connected for supplying the inflatable elements. The overlay is pliable and can be folded or rolled for transport and storage.

20 Claims, 3 Drawing Sheets

AIR SUPPORT MATTRESS OVERLAY WITH FITTED SHEET MOUNTING

BACKGROUND OF THE INVENTION

1. Field of the Invention

This invention pertains to the field of air beds and mattresses and more particularly is directed to an inflatable overlay with a fitted sheet base for easy installation over a conventional bed mattress.

2. State of the Prior Art

Air mattresses have proven to be helpful in reducing skin ulcerations and lesions suffered by persons confined to long term bed rest by illness or infirmity. Such ulcerations are due to impaired blood circulation caused by sustained pressure of skin against a mattress surface. Air mattresses of many designs are in widespread use, and several types have evolved, each suited to a different level of patient care. True air beds tend to be costly and require more complex maintenance and operation than conventional mattress hospital beds, and consequently are usually reserved for more acute care patients. Patients with a lesser degree of need can be accommodated by installation of an air pad overlay over the mattress of a conventional mattress bed. The overlay provides a relatively low cost solution where air support is needed while making use of existing beds.

Existing air support pad overlays lack a convenient means for attaching the overlay to the supporting mattress. Typically the overlay is attached by means of retaining straps engaged under the mattress. While this approach generally works, it is awkward and in some cases not entirely secure for keeping the overlay from shifting on the mattress.

A further shortcoming of existing air support overlays is the relative complexity of the air conduit system which delivers compressed air to the various inflatable bags or cushions which make up the patient support surface. Typically the air is delivered through a plastic tubing manifold which is external to the air bags and usually runs along one side of the overlay pad. This complicated external tubing manifold is vulnerable to damage, unsightly, and the materials and labor required for its manufacture represent a substantial portion of the cost of the air pad. Additionally, the external tubing manifold hinders the folding of the deflated overlay for storage or transport.

A continuing need exists for air pad overlays which are easier to handle, maintain and install, desirably at lower cost than presently known overlays.

BRIEF SUMMARY OF THE INVENTION

Responsive to the aforementioned need, this invention provides an inflatable overlay for a bed mattress which has a base sheet having a top and sides sized for making a retentive fit over a bed mattress. The sides of the base sheet are preferably joined to form a four sided skirt dependent from the top and for closely encompassing the periphery of the bed mattress. A number of inflatable elements secured to the top of the base sheet together define a body support surface. The base sheet and inflatable elements are made of a pliable sheet material such that the base sheet with the inflatable elements thereon may be folded or rolled to a compact condition off of the bed mattress for ease of transport and storage.

In a presently preferred form of the invention one or more air conduits are continuously secured to and extend across the top of the base sheet. The air conduits may be defined between the top of the base sheet and one or more sheet portions bonded to the top of the base sheet. The sheet portions are of impermeable, pliable material, which may be the same sheet material used for making the base sheet and the inflatable elements, so that the entire overlay pad can be easily folded or rolled into a compact package for convenient handling.

The inflatable elements may be generally tubular and each extends across the width of the base sheet top, each inflatable element being open to the one or more air conduits for receiving compressed air delivered to the air conduit or conduits by a suitable air supply. The inflatable elements are secured to the top of the base sheet by fasteners which may also define air passages open between the one or more air conduits and the inflatable elements. Preferably the fasteners are releasable for detaching the inflatable elements from the base sheet. For example, the fasteners may be two part fasteners including male and female components each secured to one of the base sheet and the inflatable elements, the male and female components being releaseably engageable to each other.

Two such air conduits may extend substantially the length of the base sheet top, transversely to the inflatable elements, with the fasteners being spaced along each of the two air conduits. Each inflatable element is secured by the fasteners to each of the two air conduits at points spaced apart along each inflatable element to stably secure the inflatable elements to the base sheet top. Each inflatable element may be open to each air conduit through passages defined in the fasteners so that air supplied to each of said air conduits is delivered to each of the inflatable elements. Alternatively, adjacent ones of the inflatable elements are only open to an alternate one of the two air conduits, such that air supplied to each of the air conduits is delivered only to alternate ones of the inflatable elements.

These and other features, advantages and improvements will be better understood from the following detailed description of the preferred embodiments taken in conjunction with the accompanying drawings.

DETAILED DESCRIPTION OF THE PREFERRED EMBODIMENTS

Figure 1:
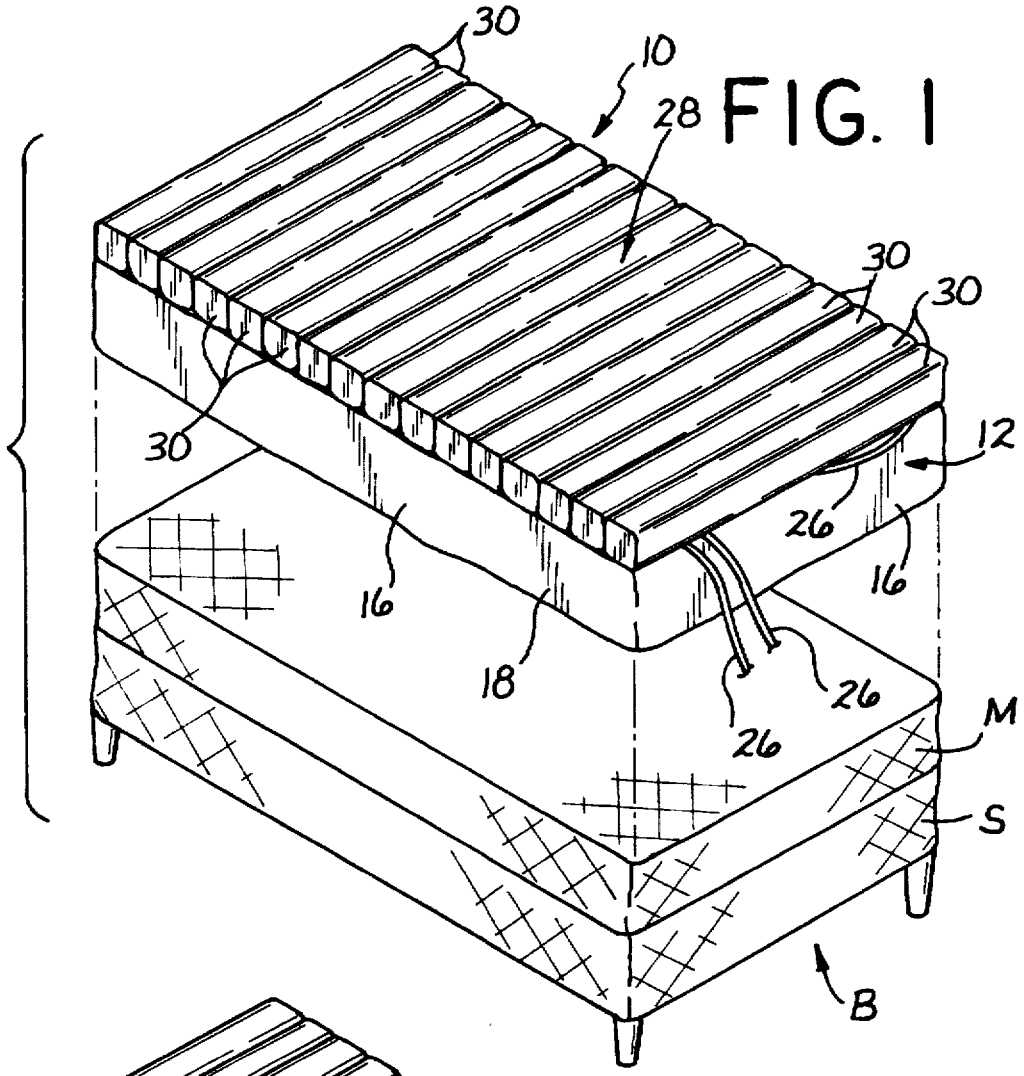
FIG. 1 is an exploded perspective view of an air support pad mattress overlay according to this invention shown above a conventional mattress bed.
Figure 2:
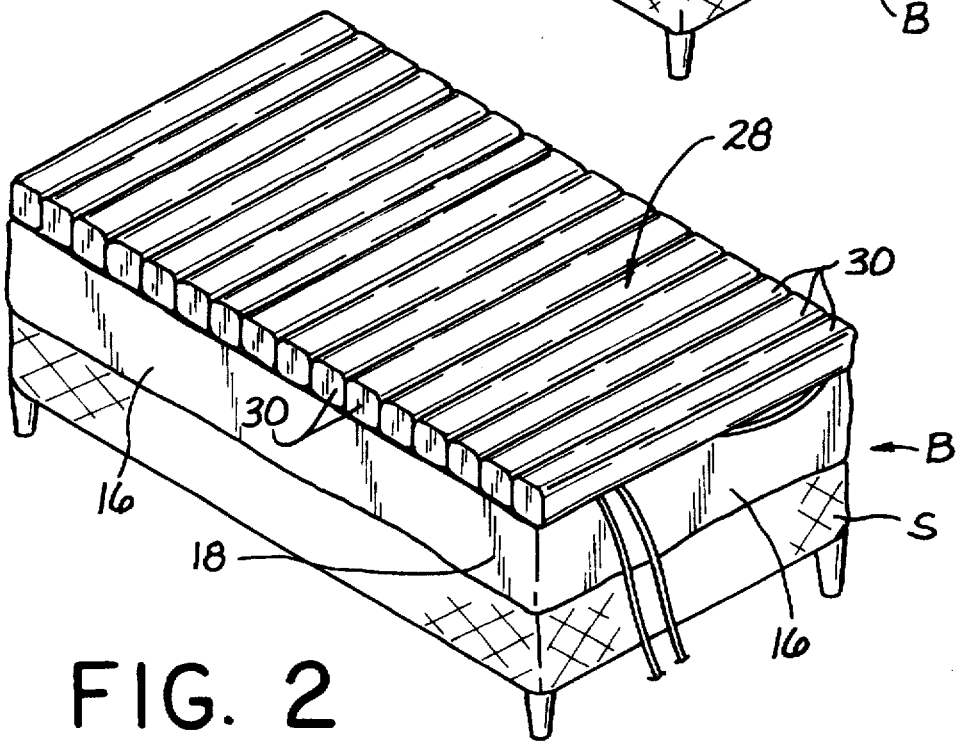
FIG. 2 shows the overlay of FIG. 1 installed on the mattress of the conventional bed.
Figure 3:
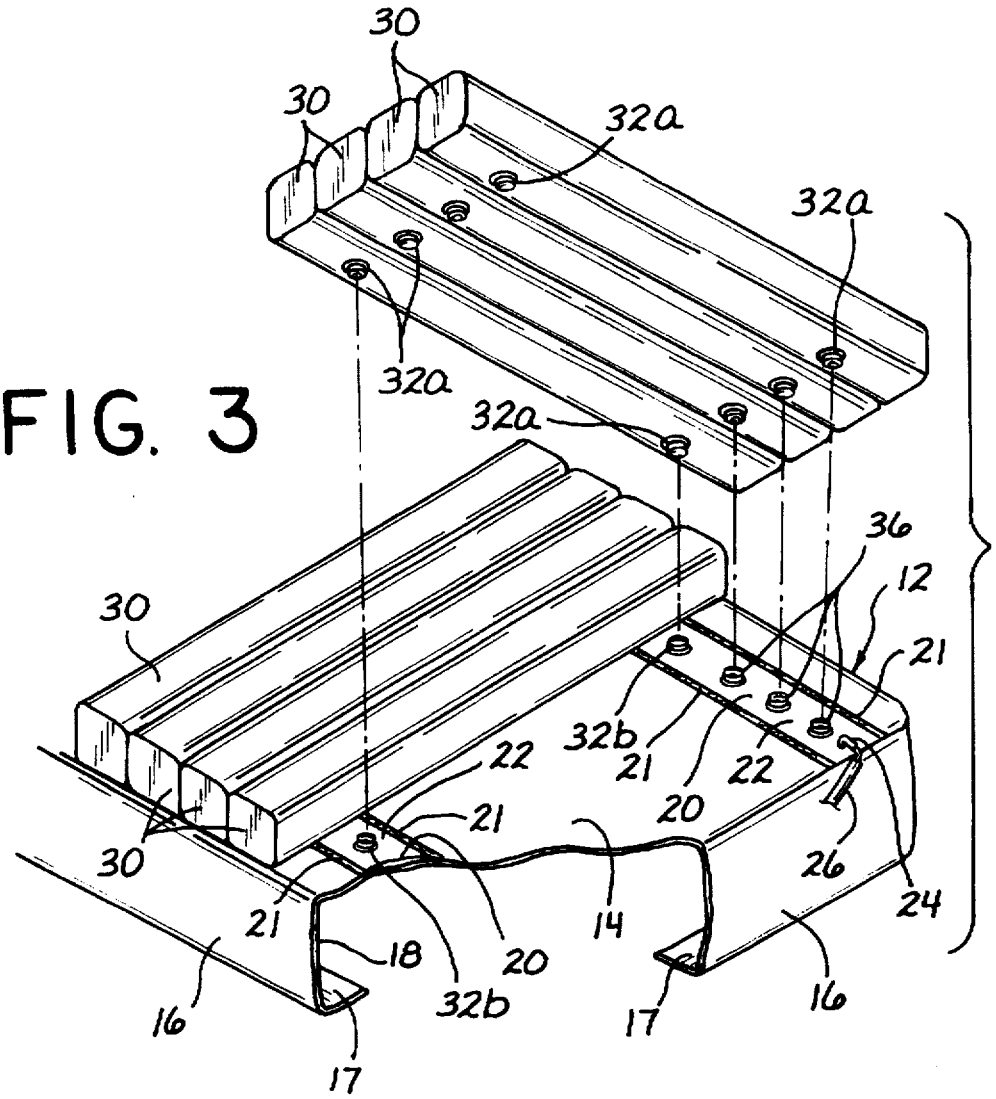
FIG. 3 is a partial perspective view of the overlay pad of FIG. 1 showing some of the inflatable air tubes exploded away from the base sheet illustrating in dotted lining the corresponding relationship between the fastener elements on the air tubes and those on the base sheet.

With reference to the drawings, FIG. 1 shows an air support pad overlay, generally designated by the numeral 10, and a conventional mattress bed B having a box spring S and a bed mattress M. The overlay pad 10 has a base sheet 12 with a sheet top 14 from which depend four sides 16 joined at four corners of the sheet to form a skirt 18 dependent from the sheet top 14, as better shown in FIG. 3. The base sheet 12 and skirt 18 is sized to make a retentive fit over the mattress M by encompassing the four sides of the mattress in the manner of conventional fitted bed sheets, as illustrated in FIG. 2. Preferably, the skirt 18 includes a horizontal lip 17 extending inwardly from the lower end or bottom of each of the four sides 16, as shown in FIG. 3. When the overlay 10 is installed lip 17 is tucked under the mattress M and is captured between the mattress M and the top surface of the box spring S. If the skirt 18 is properly sized to the dimensions of the mattress M, the sides 16 will be generally taut vertically and the lip 17 will fit securely against the underside of the mattress M to hold the top 14 in place and generally taut over the top surface of the mattress. Generally the lip 17 may be 3 to 4 inches wide, while the height of the sides 16 will depend on the height of the sides of the particular mattress to be fitted, about 6 inches being a typical dimension.

Figure 5:
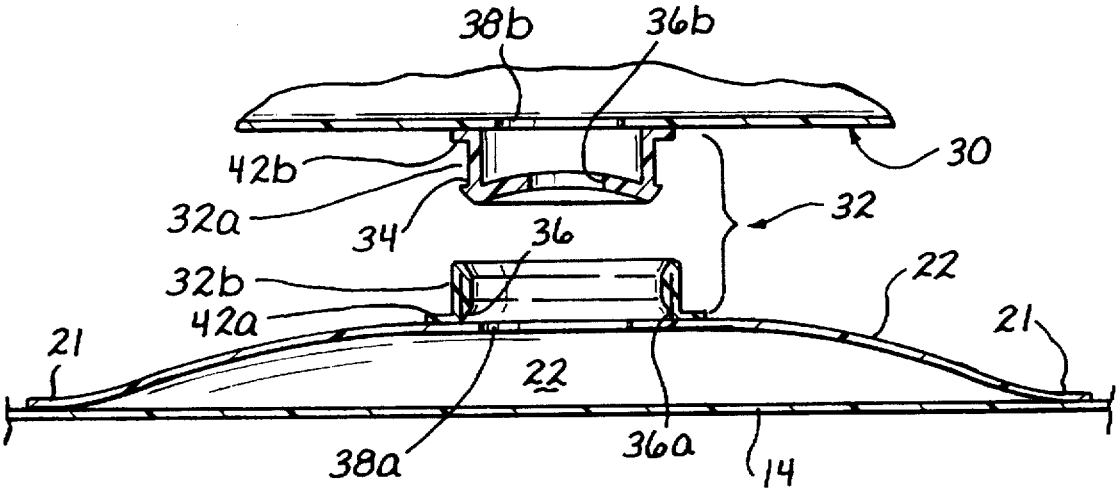
FIG. 5 is a section of separate male and female fastener elements taken along line of 5—5 in FIG. 4.
Figure 5A:
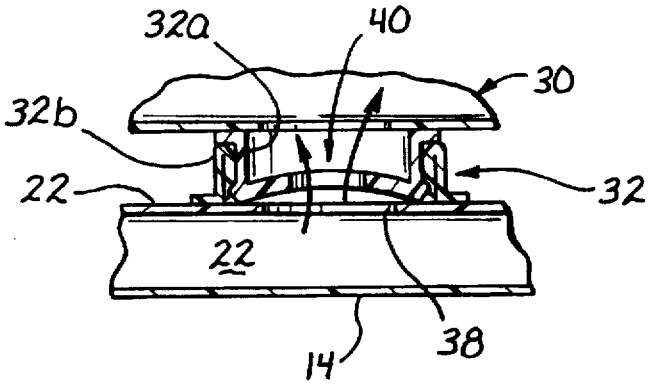
FIG. 5A shows the fastener elements of FIG. 5 engaged to each other and defining an air passage between the inflatable air tube and the air conduit.
Figure 5B:
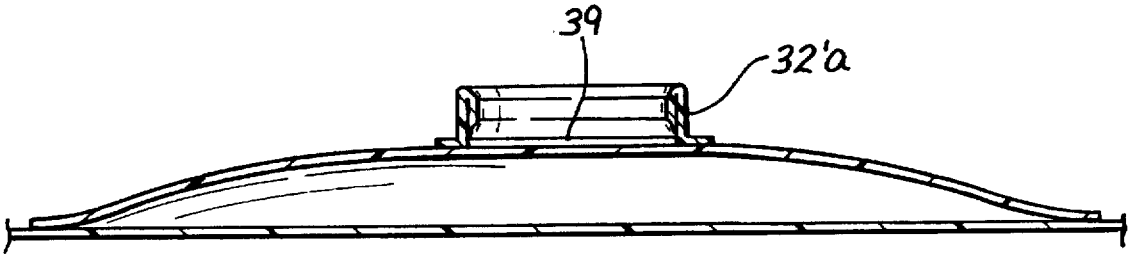
FIG. 5B is a section taken along line 5B—5B in FIG. 4 of a closed female fastener element.

Two strips 20 of sheet material similar to the material of the base sheet 12 are each continuously bonded to the top 14 of the base sheet along two parallel air tight joint lines to define an air conduit 22 between each strip 20 and the top 14 of the base sheet, as best understood by reference to FIGS. 5 and 5B. The two air conduits 22 extend approximately the full length of the base sheet top 14, and at one end of each air conduit is an air supply tube 24 which is connected by tube 26 to a suitable supply of compressed air (not shown in the drawings). The opposite end of each air conduit 22 is sealed.

Figure 4:
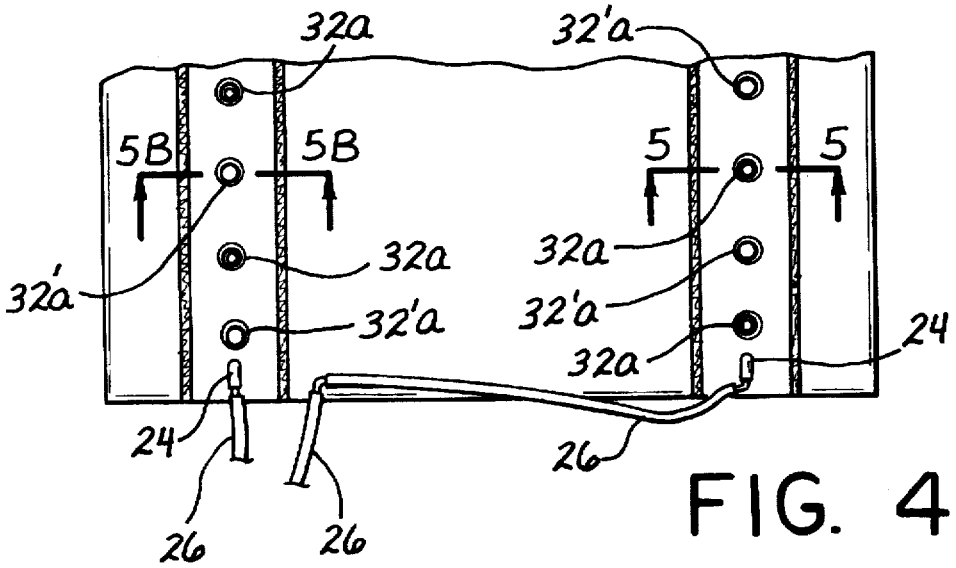
FIG. 4 is a fragmentary top plan view of one end of the overlay pad with the inflatable elements detached to expose the air conduits and fasteners on the base sheet, as well as air supply connections to the two air conduits.

A number of inflatable air tubes 30 are attached to the base sheet top 14 to define a body support surface 28. The inflatable tubes extend approximately the full width of the base sheet top transversely to the air conduits 22, as shown in FIG. 3. Each air tube 30 is attached to the base sheet by two fasteners 32 spaced apart along the length of the air tube. Each fastener 32 consists of a male element **32*a* and a female element 32*b* secured respectively to air tube and the top 14 of the base sheet. More specifically, the female elements 32*b* of the fasteners 32 are spaced at even intervals along each of the air conduits 22, as shown in top plan view in FIG. 4. Each of the two male fastener elements 32*a* on each air tube mates to a female fastener element 32*b* on one of the two air conduits 22, as suggested by the dotted vertical lines in FIG. 3, so that each air tube is stably secured across the width of the base sheet top 14. The spacing of the female fastener elements 32*b* is such that the inflated air tubes are closely adjacent in mutually parallel relationship to form a generally continuous support surface 28**.

FIGS. 5 and 5A illustrate the male and female fastener elements **32*a*, 32*b* respectively, before and after engagement. Both fastener elements are made of flexible plastic material. A radial shoulder 34 on the male element expands into an annular recess 36 in the female element to make interlocking engagement when the male element is pressed into the female element. The resilient nature of the plastic material permits the two fastener elements to be pulled apart and disengaged from each other, allowing the inflatable air tubes 30 to be individually detached from the base sheet 12**, for example, for replacement or repair.

The male element **32*b* has an interior opening 36*b*, while the female fastener element 32*a* has an interior opening 36*a*. These openings of the mated faster elements open onto a third opening 38 formed in the sheet strip 20 so that, in the engaged condition of FIG. 5*a*, the assembled fastener 32 defines an air passage 40 opening the interior of the air tube 30 to the air conduit 22. Compressed air supplied to the air conduit 22 is admitted through the passage 40 for inflating the air tube 30**, as suggested by the vertical arrows in the Figure.

In one form of the overlay pad 10, all of the fasteners 32 along both air conduits 22 are interiorly apertured as in FIG. 5A, so that air is supplied from both air conduits to each inflatable air tube 30. This form of the invention is suitable for static air support pads in which the air tubes 30 are filled to a suitable internal air pressure and the two air supply tubes 24 are capped off, and also for variable pressure air support pads in which the supply tubes 26 are connected to a common electronically controlled air supply capable of maintaining a desired adjustable internal pressure in the air tubes 30. Suitable controlled air supplies are readily available for this purpose from various manufacturers and distributors of hospital beds.

In an alternate form of the overlay pad 10, each air tube 30 is in fluidic communication with only one of the air conduits 22. This is achieved by providing one interiorly closed fastener for each air tube. FIG. 5B show a female fastener element **32*a*' which is interiorly closed to prevent air flow between the air conduit 22 and an air tube 30 engaged to the closed female fastener element by means of an apertured male fastener element 32*b* as previously described. The open and closed fasteners 32, 32' alternate from one to the other of the two air conduits 22 for each successive air tube 30 along the length of the base sheet top 14. The result is that each air conduits supplies air to alternate ones of the air tubes. This air supply arrangement is used for so-called alternating pressure air mattresses, where compressed air is alternately supplied to one group of air tubes through one tube 26 while air is vented from a second group of air tubes through the other tube 26**, the tubes of the two groups alternating along the length of the overlay pad. This is accomplished by means of a alternating pressure air supply and valve arrangement of conventional design, which are likewise commercially available.

The base sheet 12, the sheet strips 20 and the inflatable tubes are all made of pliable sheet material impermeable to air, such as pliable polyvinylchloride (PVC) sheet stock. The sheet strips 20 may be bonded to the base sheet top 14 by radio frequency welding, a process which has proved effective for making reliable air-tight joint lines between sheets of PVC or of other radio frequency weldable plastics. The fasteners 32 can also be of PVC and similarly welded by air tight seals to the strips 20 and air tube 30 along annular rims **42*a* and 42*b* respectively, as shown in FIG. 5. It should be understood, however, that the overlay pad 10** is not limited to any particular materials or method of assembly or welding.

It is also contemplated that the air conduits 22 may take the form of tubing or conduits which are not defined together with the base sheet top 14, but which tubing or conduits are joined to the base sheet top in generally continuous fashion along its length so as to effectively secure the inflatable air tubes 30 to the base sheet and also to permit the tubes and conduits to roll up or fold with the base sheet 12 to a compact condition.

The air support pad overlay 10 with the fitted skirt 18 can be easily and quickly installed on or removed from a conventional mattress bed B, whether the air tubes 30 are inflated or deflated. The skirt 18 provides a simple, economical and easy to use mounting for installing an air support overlay over a conventional mattress bed. Air support pad overlays of different types mentioned above can be equally provided with the fitted skirt 18, so that the support requirements of a particular patient may be met by selecting and installing an appropriate overlay pad over an existing mattress bed. The overlay pad 10 is relatively lightweight and can be usually handled, carried and installed by one person. With the air tubes 30 deflated, the overlay pad 10 can be easily rolled or folded to a compact sized package which is conveniently carried and can be stored out of the way in a relatively small space, allowing an inventory of such air support overlay pads to be kept on hand without excessive storage space requirements.

Particular embodiments of the invention have been described and illustrated for purposes of clarity and example only, and not by way of limitation of the scope of the following claims which define the scope of this invention.

What is claimed as new is:

1. An inflatable overlay for a bed mattress comprising:

a base sheet having a top and sides sized for making a retentive fit over a said bed mattress;

a plurality of inflatable elements secured to said top, said inflatable elements together defining a body supporting surface;

said base sheet and said inflatable elements being made of pliable sheet material such that the base sheet with said inflatable elements thereon may be folded or rolled to a compact condition off of the said bed mattress for ease of transport and storage; and one or more sheet portions of impermeable pliable sheet material bonded to said top for defining with said base sheet one or more air conduits, said inflatable elements being open to said one or more air conduits.

2. The inflatable overlay of claim 1 wherein said sides of the base sheet are joined to form a four sided skirt dependent from said top for closely encompassing four sides of the a said bed mattress.

3. The inflatable overlay of claim 1 wherein said inflatable elements are generally tubular and each extends across said top of the base sheet.

4. The inflatable overlay of claim 1 further comprising an air supply connected to said one or more air conduits for supplying compressed air to said inflatable elements.

5. The inflatable overlay of claim 1 further comprising fasteners securing said inflatable elements to said top, said fasteners defining air passages between said one or more air conduits and said inflatable elements.

6. The inflatable overlay of claim 1 wherein said fasteners are releasable for detaching said inflatable elements from said base sheet.

7. The inflatable overlay of claim 1 wherein said fasteners comprise male and female components each secured to one of said base sheet and said inflatable elements, said male and female components being releaseably engageable to each other for detachably fastening said inflatable elements to said base sheet.

8. The inflatable overlay of claim 1 wherein said inflatable elements are generally tubular and each extends across said top of the base sheet, said one or more air conduits comprise two said air conduits each extending substantially across said top transversely to said inflatable elements, said fasteners being spaced along said air conduits, each of said inflatable elements being secured by said fasteners to each of said air conduits at points spaced apart along said each of said inflatable elements thereby to stably secure said inflatable elements to said top of the base sheet.

9. The inflatable overlay of claim 8 wherein each of said inflatable elements is open to each of said air conduits, such that air supplied to each of said air conduits is delivered to each of said inflatable elements.

10. The inflatable overlay of claim 8 wherein adjacent ones of said inflatable elements are only open to an alternate one of said air conduits, such that air supplied to each of said air conduits is delivered to alternate ones of said inflatable elements.

11. The inflatable overlay of claim 1 wherein said inflatable elements are generally tubular and each extends across said top of the base sheet, said one or more air conduits comprise two said air conduits each extending substantially across said top transversely to said inflatable elements, said fasteners being spaced along said air conduits, each of said inflatable elements being secured by said fasteners to each of said air conduits at points spaced apart along said each of said inflatable elements thereby to stably secure said inflatable elements to said top of the base sheet.

12. An inflatable overlay for a bed mattress comprising:

a base sheet having a top, four sides dependent from said top forming a skirt, and a lip extending inwardly to said skirt from a lower end of each of said four sides, said skirt and lip being fitted for retentively encompassing four sides of the a said bed mattress thereby to secure said top over the a said bed mattress;

one or more sheet portions of impermeable pliable sheet material bonded to said top for defining with said base sheet one or more air conduits;

a plurality of inflatable elements secured to said top, said inflatable elements together defining a body supporting surface;

said inflatable elements being open to said one or more air conduits;

said base sheet and said inflatable elements being made of an impermeable pliable sheet material such that the base sheet with said inflatable elements thereon may be folded or rolled to a compact condition off of the bed mattress for ease of transport and storage.

13. The inflatable overlay of claim 12 further comprising releasable fasteners for detachably securing said inflatable elements to said top, said fasteners defining air passages between said one or more air conduits and said inflatable elements.

14. An inflatable overlay for a bed mattress comprising:

a base sheet having a top, four sides joined to form a four sided skirt dependent from said top, said skirt including a lip extending inwardly to said skirt from a lower end of each of said sides, said top and skirt being dimensioned for making a close fit over the a said bed mattress a plurality of generally tubular inflatable elements each extending across said top of the base sheet, said inflatable elements together defining a body supporting surface on said top;

sheet portions of impermeable pliable sheet material bonded to said top for defining with said base sheet two said air conduits each extending substantially across said top transversely to said inflatable elements;

releasable fasteners for detachably securing said inflatable elements to said top, said fasteners defining air passages between said one or more air conduits and said inflatable elements, said fasteners being spaced along said air conduits, each of said inflatable elements being secured by said fasteners to each of said air conduits at points spaced apart along said each of said inflatable elements thereby to stably secure said inflatable elements to said top of the base sheet;

said base sheet and said inflatable elements being made of an impermeable pliable sheet material such that the base sheet with said inflatable elements thereon may be folded or rolled to a compact condition off of the a said bed mattress for ease of transport and storage.

15. The inflatable overlay of claim 14 wherein said fasteners comprise male and female components each secured to one of said base sheet and said inflatable elements, said male and female components being releaseably engageable to each other for detachably fastening said inflatable elements to said base sheet.

16. The inflatable overlay of claim 14 wherein each of said inflatable elements is open to each of said air conduits, such that air supplied to each of said air conduits is delivered to each of said inflatable elements.

17. The inflatable overlay of claim 14 wherein adjacent ones of said inflatable elements are only open to an alternate one of said air conduits, such that air supplied to each of said air conduits is delivered to alternate ones of said inflatable elements.

18. An inflatable overlay for a bed mattress comprising:

a base sheet of pliable material having a top and four sides to form a four sided skirt dependent from said top for retentively encompassing four sides of the a said bed mattress;

one or more air conduits extending substantially across said top and continuously secured thereto;

a plurality of inflatable elements; and releaseable fasteners for securing said inflatable elements to said top, said inflatable elements together defining a body supporting surface, said fasteners also opening said inflatable elements to said air conduits;

said one or more air conduits and said inflatable elements being made of impermeable pliable sheet material such that the base sheet with said one or more air conduits and said inflatable elements thereon may be folded or rolled to a compact condition off of the a said bed mattress for ease of transport and storage.

19. An inflatable overlay for a bed mattress comprising:

a base sheet having a top and a skirt dependent from said top for making a retentive fit over a said bed mattress;

a plurality of inflatable elements; and fasteners individually releaseably securing each of said inflatable elements to said top, said inflatable elements together defining a body supporting surface;

said base sheet and said inflatable elements being made of pliable sheet material such that the base sheet with said inflatable elements thereon may be folded or rolled to a compact condition off of the a said bed mattress for ease of transport and storage.

20. The inflatable overlay of claim 19 wherein said inflatable elements are generally tubular and each extends across said top of the base sheet, each of said inflatable elements being releaseably secured to said base sheet by said fasteners at points spaced apart along said each of said inflatable elements thereby to stably secure said inflatable elements to said top of the base sheet.

* * * * *